United States Patent [19]

Oh

[11] Patent Number: 5,067,473

[45] Date of Patent: Nov. 26, 1991

[54] HEATER WITH A HUMIDIFIER

[75] Inventor: Tae S. Oh, Suwon, Rep. of Korea

[73] Assignee: Samsung Electronics Co., Ltd., Suwon, Rep. of Korea

[21] Appl. No.: 553,803

[22] Filed: Jul. 18, 1990

[30] Foreign Application Priority Data

Jul. 19, 1989 [KR] Rep. of Korea ..... 10486/89[U]

[51] Int. Cl.[5] ..... F24F 3/14; F24H 3/00

[52] U.S. Cl. ..... 126/113; 126/350 B; 261/153; 261/155

[58] Field of Search ..... 126/113, 508, 350 B, 126/364, 369; 261/153, 155; 165/911; 237/78 R, 58

[56] References Cited

U.S. PATENT DOCUMENTS 2,089,662 8/1937 Potter ..... 126/350 B
2,244,017 6/1941 Maxwell ..... 261/153
2,363,953 11/1944 Forrester ..... 126/113

FOREIGN PATENT DOCUMENTS 62-245050 10/1987 Japan .

*Primary Examiner*—James C. Yeung
*Attorney, Agent, or Firm*—Cushman, Darby & Cushman

[57] ABSTRACT

A heater with a humidifier wherein the humidifier comprises a plurality of double pipes in the uppermost line of the heat exchanging pipes of the heater. The double pipe includes an inner pipe for burned gas flow and an outer pipe for containing humidifying water, both of which are arranged concentrically. A plurality of orifices are formed at the top portion of the outer pipe so that the steam generated from the humidifying water by heat of the burned gas in the inner pipe may be spurted from the orifices to humidify the air stream blown by a blower. The outer pipes are connected to a common feed-water pipe in which a flow control valve may be provided. The control valve is also electrically connected to a feed-water level sensor in the outer pipe so that the level of the water in the outer pipe may be detected and controlled.

3 Claims, 2 Drawing Sheets

HEATER WITH A HUMIDIFIER

FIELD OF THE INVENTION

This invention relates to a forced convection-type heater with a humidifier.

BACKGROUND OF THE INVENTION

Generally, a forced convection-type heater has been widely used in heating a relatively voluminous indoor space. In the case such a heater runs for a long time, the indoor air becomes impure and dry, and this causes indoor workers to have respiratory trouble. Therefore, use of a humidifier is essential to use of the heater.

One example of a humidifier for use in such a heater is disclosed in Japanese Laid-Open Publn. No. SHO 62-245050 of Oct. 26, 1987. The humidifier which is disclosed in that publication comprises a humidifying water tank enclosing a burner with an air stream passage defined between the tank and burner. The burner heats the air stream blown by a blower, and the humidifying water, to generate steam. The heated air stream carrying the steam is blown into the indoor space by a conventional blower.

However, the heater equipped with such humidifier results in a large size for the equipment.

FIG. 1 is a schematic view illustrating another heater having a humidifier of the prior art, which the present invention directly improves. In FIG. 1, a humidifying water tank 32 with its top open is mounted on the burned gas distribution chamber 30 formed at the end portion of the burner 20. The humidifying water is heated by the heat produced by burning gas in the chamber 30, and steam is thereby generated. The chamber 30 is also provided with a plurality of pipes 35 which are arranged above the burner 20 and directed to the exhaust gas collection tank 50. The generated steam is introduced into the air stream, which is heated while passing the burner 20 and pipes 35 in turn, and the humidified and heated air is blown into the indoor space.

Although the heater as described hereinabove in regard to FIG. 1 is more excellent in the thermal efficiency than the heater disclosed in Japanese Laid-Open Publn. No. SHO 62-245050, the humidifying effect is still not sufficient. Furthermore, when a sudden impact is given to the heater, humidifying water may be spilled from the open top of the water tank and the parts of the heater are thereby damaged.

SUMMARY OF THE INVENTION

One object of the invention is to provide a heater with a humidifier excellent in thermal efficiency and humidifying effect, that does not suffer from the above mentioned disadvantages.

Another object of this invention is to provide a forced convection-type heater comprising a burner, a burned gas distribution chamber formed at the one end portion thereof, a plurality of heat exchanging pipes arranged in parallel between the burned gas distribution chamber and the exhaust gas collection tank mounted on the other end portion of the burner, an air blower and a humidifier, wherein the humidifier comprises a plurality of double structure pipes with an inner pipe for burned gas flow to the exhaust gas collection tank and an outer pipe which are arranged concentrically, the outer pipe being larger than the inner pipe so that the space formed between them may contain humidifying water, the top portion of the outer pipe being provided with a plurality of orifices so that the steam generated by the heat of the burned gas passing through the inner pipe may be spurted up by its pressure and the double structure pipes being arranged at the uppermost line of the heat exchanging pipes.

Each outer pipe of the double structure pipes is connected to a common feed-water pipe provided with a control valve, and a water level sensor electrically connected to the control valve may be provided on the outer pipe to detect the level of humidifying water in the inner space thereof. It is desirable that the control valve be a solenoid valve.

BRIEF DESCRIPTION OF THE DRAWINGS

The present invention will be clearly understood by the description of its embodiment illustrated in the drawings attached hereto.

In the Drawings.

DESCRIPTION OF THE PREFERRED EMBODIMENT

Figure 1:
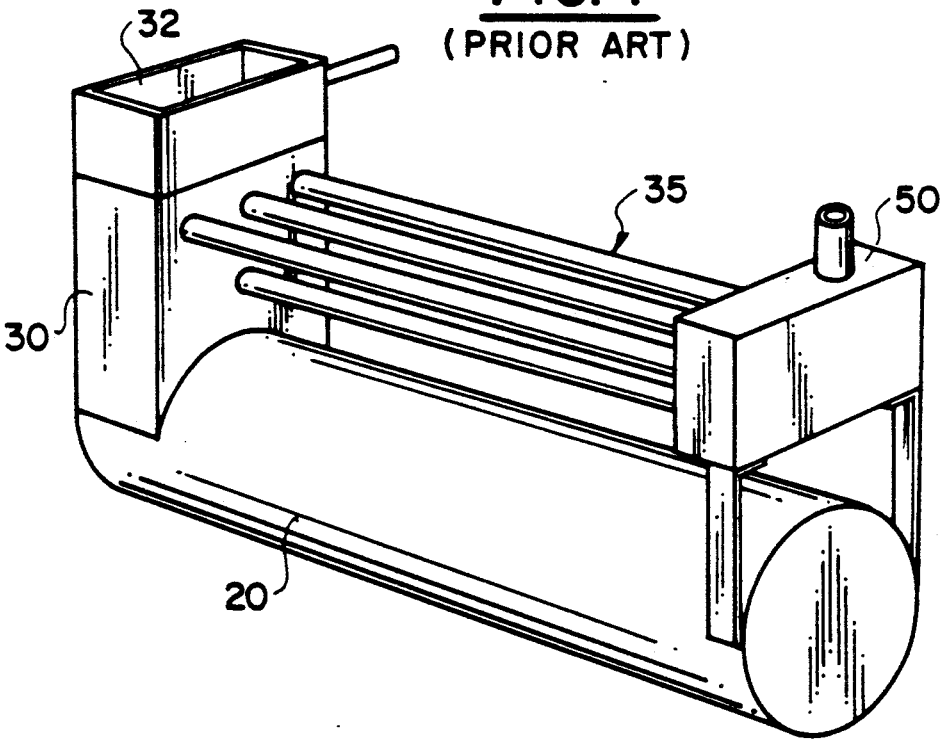
FIG. 1 (PRIOR ART)
FIG. 1 is a perspective view of the heater with a humidifier according to the prior art.
Figure 2:
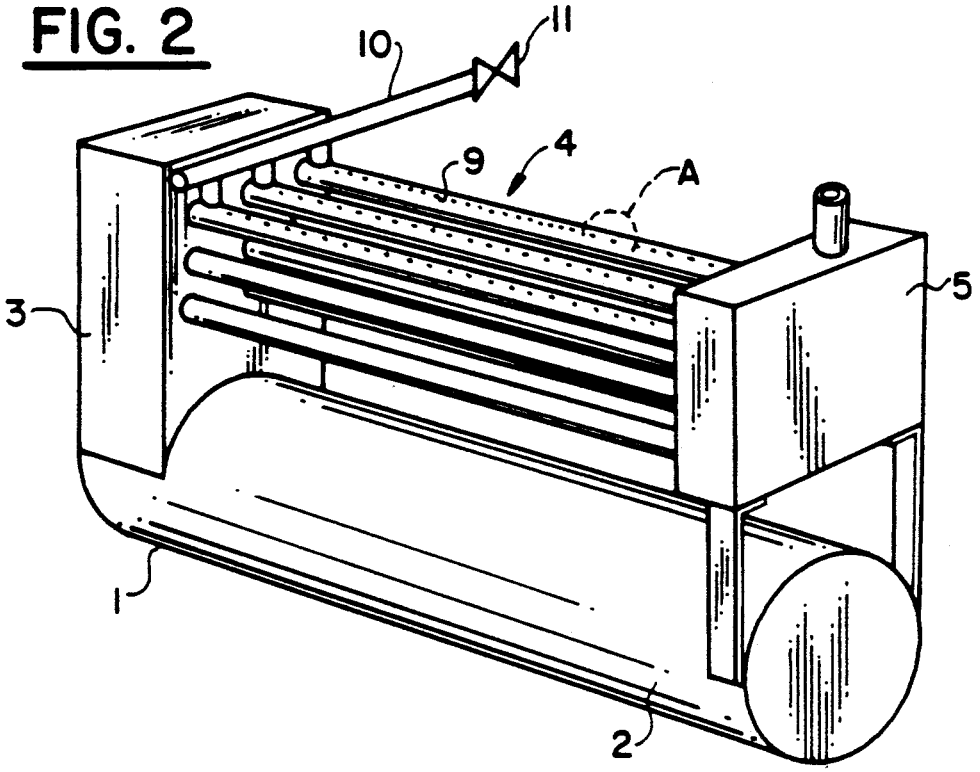
FIG. 2 is a perspective view of the heater with a humidifier according to the present invention.
Figure 3:
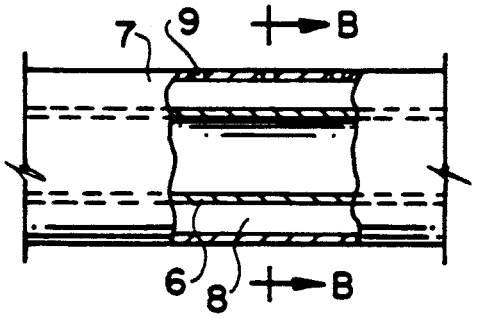
FIG. 3 is a partial sectional view of the part indicated as A in FIG. 2, showing a double pipe.

In the heater 1 illustrated in FIGS. 2 and 3, a burner 2 is installed in the lower part thereof, and burned gas is exhausted from a burned gas collection tank 5 through a plurality of heat exchanging pipes 4 and a burned gas distribution chamber 3 formed at the one end portion of the burner 2. The air blown by a blower (not shown) is heated while passing the burner 2 and heat exchanging pipes to the front of the heater.

According to the present invention, the uppermost line of the pipes 4 arranged in a plurality of lines between the distribution chamber 3 and collection tank 5 is provided with a plurality of double-structure pipes and each of double-structure pipes has an inner pipe 6 for burned gas flow and an outer pipe 7 which is concentrically arranged with the inner pipe and is larger in diameter than the inner pipe. A space 8 for humidifying water storage is formed between the outer surface of the inner pipe and the inner surface of the outer pipe. The space 8 is filled with humidifying water up to a predetermined level. A plurality of orifices 9 are formed on the top portion of the outer pipe 7. The humidifying water stored in the space 8 is heated up to 80°-90° C. by the burned gas, which is at 150°-180° C. and steam is thereby generated. The steam may be spurted through the orifices 9 by its pressure in the space 8. The spurted steam is introduced into the air stream blown by a blower (not shown) and discharged from the heater.

Figure 4:
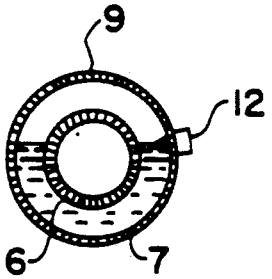
FIG. 4 is a sectional view taken along the line B—B of FIG. 3.

Each outer pipe 7 of the double-structure pipes is connected to a common feed-water pipe 10 which is provided with a flow control valve 11. As shown in FIG. 4, a water level sensor 12 is provided with the outer pipe 7, one of the double-structure pipes which is electrically connected to the control valve 11.

If the detected level of the water in the space 8 is lower than a predeterminded level, sensor 12 outputs a signal to the control valve 11 so that the valve 11 may be opened to supplement the humidifying water into the space 8. Therefore, the level of humidifying water in the space 8 may be constantly maintained at the predetermined level.

According to the present invention, the heater with a humidifier can be produced in a relatively small size, and high thermal efficiency and uniformly humidifying effect are obtained.

While a preferred embodiment has been described, such description is for illustrative purpose only, and it is to be understood that changes and variations may be made without departing from the spirit or scope of the following claims.

What is claimed is:

1. A combined forced convection-type heater and humidifier, comprising:

an elongated burner having two opposite ends;

a burner gas distribution chamber disposed at one end of said burner, in communication with said burner for receiving hot burner gas from said burner;

an exhaust gas collection tank disposed at an opposite end of said burner;

a plurality of double-walled pipes disposed parallel to one another and mounted so as to extend generally horizontally between said burner gas distribution chamber and said exhaust gas collection tank; each said double-walled pipe comprising an inner wall enclosing a first space, and an outer wall, spaced from, but coaxial with, the respective said inner wall and enclosing a second, annular space; each said first space communicating between said burner gas distribution chamber and said exhaust gas collection chamber, so that, in use, hot combustion gas may flow from said burner gas distribution chamber to said exhaust gas collection chamber through said first spaces of said double-walled pipes for thereby indirectly heating air forced externally across said double-walled pipes; said second spaces being closed off from communication with said burner gas distribution chamber and said exhaust gas collection chamber;

means defining a plurality of steam outlet openings through each said outer wall in an upper portion of each said outer wall; and means for introducing a supply of water into said second spaces, so that as hot combustion gas flows through said first spaces, said inner walls become heated, causing the water to boil in said second spaces, and to spurt through said steam outlet openings into the air which is being indirectly heated while being forced to flow externally across said double-walled pipes.

2. The combined forced convection-type heater and humidifier of claim 1, wherein:

said means for introducing a supply of water into said second spaces includes:

a water feed pipe means communicated to said second spaces;

a flow control valve interposed in said water feed pipe means for controlling flow of water through said water feed pipe means to said second spaces; and water level sensor means operatively associated with one of said second spaces and with said flow control valve, for causing said flow control valve to provide sufficient water flow through said water feed pipe means for maintaining water in said second spaces up to a predetermined level.

3. The combined forced convection-type heater and humidifier of claim 2, wherein:

said flow control valve is a solenoid valve.

* * * * *